US005984542A

United States Patent [19]

Verlinden et al.

[11] Patent Number: 5,984,542

[45] Date of Patent: Nov. 16, 1999

[54] VESSEL FOR THE WET PROCESSING OF PHOTOGRAPHIC SHEET MATERIAL

[75] Inventors: Bart Verlinden, Tongeren; Patrick Van den Bergen, Hove, both of Belgium

[73] Assignee: Agfa-Gevaert N.V., Mortsel, Belgium

[21] Appl. No.: 09/096,671

[22] Filed: Jun. 12, 1998

[51] Int. Cl.[6] ..... G03D 3/02

[52] U.S. Cl. ..... 396/626; 396/636; 396/612

[58] Field of Search ..... 396/612, 614, 396/622, 626, 636, 641

[56] References Cited

U.S. PATENT DOCUMENTS

| | | | |
|---|---|---|---|
| 3,635,144 | 1/1972 | Beck | 396/626 |
| 4,187,023 | 2/1980 | Schausberger et al. | 396/626 |
| 5,140,355 | 8/1992 | Haag et al. | 396/612 |

FOREIGN PATENT DOCUMENTS

| | | |
|---|---|---|
| 0348869 | 6/1989 | European Pat. Off. . |
| 0622678 | 4/1994 | European Pat. Off. . |
| 0744656 | 11/1996 | European Pat. Off. . |

*Primary Examiner*—D. Rutledge
*Attorney, Agent, or Firm*—Baker & Botts, L.L.P.

[57] ABSTRACT

The vessel (10) comprises a housing (12) having openings (14, 16) closed by pairs of rotatable path-defining rollers (18, 20, 22, 24) through which a sheet material path (30) extends. Liquid level control means (38) define a dynamic liquid level (L) in the treatment chamber (32) above the sheet material path (30). A buffer comprises one or more drip chambers (34, 36) positioned to receive liquid escaping from the treatment chamber (32) through the nips (26, 28) and between the rotatable path-defining rollers (18, 20, 22, 24) and the housing (12). The buffer has a maximum total volume such that a static liquid level (S) is established below the sheet material path (30), without the buffer overflowing. In a non-operative condition, treatment liquid, which escapes through the nips and between the path-defining rollers and the housing, is all retained in the buffer, for later re-use as desired.

10 Claims, 2 Drawing Sheets

VESSEL FOR THE WET PROCESSING OF PHOTOGRAPHIC SHEET MATERIAL

FIELD OF THE INVENTION

The present invention relates to an apparatus and method for the processing of sheet material, especially photographic sheet material such as X-ray film, pre-sensitised plates, graphic art film and paper, and offset plates. More particularly the invention relates to improvements in apparatus and method in which photographic material is transported through one or more treatment units.

BACKGROUND OF INVENTION

As a rule, a processing apparatus for photographic sheet material comprises several vessels each of which contains a treatment liquid, such as a developer, a fixer and a rinse liquid. As used herein, the term "sheet material" includes not only photographic material in the form of cut sheets, but: also in the form of a web unwound from a roll. The sheet material to be processed is transported through these vessels in turn, by transport means such as one or more pairs of drive rollers, and thereafter optionally to a drying unit. The time spent by the sheet material in each vessel is determined by the transport speed and the dimensions of the vessel in the sheet feed path direction.

Apparatus for the processing of photographic sheet material such as aluminium lithographic printing plates is known, for example from EP-A-410500 (Agfa Gevaert NV), comprising a plurality of treatment vessels mounted one beside another to define a substantially horizontal sheet material path through the apparatus. Each vessel comprises a housing having a sheet material inlet and a sheet material outlet. The inlet and outlet are each closed by a pair of rotatable path-defining rollers biased into contact with each other to form a nip there-between through which the sheet material path extends.

The path-defining rollers are used to remove excess treatment liquid from the sheet as it passes from one treatment vessel to the next. This reduces carry-over of treatment liquid and thereby reduces contamination and wastage. A good removal of processing liquid is also required to reduce the drying time of the sheet material after the last process bath, and hence to reduce the energy use. Sealing means may be provided to seal each path-defining roller to the housing and liquid level control means to define a dynamic liquid level above the nip plane.

It has been proposed to provide drip trays so positioned to collect treatment liquid which may escape through each nip and/or between the path-defining rollers and the sealing means.

However, when the processor is in a non-operative condition, treatment liquid continues to escape into the drip chambers. These drip chambers eventually overflow and treatment liquid is lost. If the escape of treatment liquid through the nips, and between the path-defining rollers and the sealing means is reduced, the possible disadvantage arises that any photographic sheet material present in the vessel remains immersed in treatment liquid.

OBJECTS OF INVENTION

It is an objective of the present invention to provide a vessel for a photographic sheet material processing apparatus in which the aforesaid disadvantage is overcome.

SUMMARY OF THE INVENTION

We have now discovered that this objective, and other useful benefits, may be obtained when the drip chambers form part of a buffer, the total volume of which is such that a static liquid level is established below the sheet material path, without the buffer overflowing.

Thus, according to a first aspect of the invention, there is provided a vessel for the wet processing of photographic sheet material, comprising a housing having entrance and exit openings defining a generally horizontal sheet material path through the vessel, the entrance opening being closed by a pair of rotatable path-defining rollers urged towards each other to form an entrance nip therebetween, through which the sheet material path extends, the exit opening being closed by a pair of rotatable path-defining rollers urged towards each other to form an exit nip therebetween through which the sheet material path extends, whereby the rotatable path-defining rollers and the housing define a closed treatment chamber within the vessel, liquid level control means to define a dynamic liquid level in the treatment chamber above the sheet material path, and one or more drip chambers positioned to receive liquid escaping from the treatment chamber through the nip and between the rotatable path-defining rollers and the housing, characterised by a buffer which comprises the drip chambers and has a maximum total volume such that a static liquid level is established below the sheet material path, without the buffer overflowing.

In a second aspect of the invention, there is provided a method for the wet processing of sheet material, comprising:

feeding sheet material through a vessel along a generally horizontal sheet material path defined by a housing having entrance and exit openings, the entrance opening being closed by a pair of rotatable path-defining rollers urged towards each other to form an entrance nip therebetween, through which the sheet material path extends, the exit opening being closed by a pair of rotatable path-defining rollers urged towards each other to form an exit nip therebetween, through which the sheet material path extends, whereby the rotatable path-defining rollers and the housing define a closed treatment chamber within the vessel, and establishing an operative condition in which a dynamic liquid level in the treatment chamber lies above the sheet material path, characterised by establishing a non-operative condition in which a static liquid level lies below the sheet material path by receiving liquid escaping from the treatment chamber through the nips and between the rotatable path-defining rollers and the housing in a buffer comprising one or more drip chambers, the buffer having such a maximum total volume such that the non-operative condition is established without the buffer overflowing.

It is desirable that the treatment liquid in one vessel is not contaminated by contents of the adjacent vessels, that is neither by the treatment liquid of an adjacent vessel nor by vapours escaping from one vessel to another. Furthermore, in order to reduce consumption of treatment liquids, it is desirable to reduce the evaporation, oxidation and carbonisation thereof. Preferably therefore, each path defining roller is associated with sealing means for sealing the associated rotatable path-defining roller to the housing.

The sealing means may contact the path defining roller at a position located between 45° and 315° from the nip. However, if the sealing means contacts the path defining roller at a position located less than 180°, such as between 45° and 135° from the nip on the liquid side, or on the non-liquid side, this arrangement enables the rotatable path-defining rollers away to be moved away from each other, and from the sealing means, for reasons explained below.

Each of the sealing means may comprise a rotatable sealing member, such as a sealing roller, in contact with the rotatable path-defining roller along its length. Preferably, the sealing roller is carried by a longitudinal bearing which constitutes a stationary sealing member. By the use of a rotatable sealing member in place of a stationary sealing member, the torque which needs to be applied to the rotatable path-defining roller can be significantly reduced. This reduces the power needed by the processor, reduces wear on the rotatable path-defining roller, reduces the mechanical deformation thereof and thereby extends the expected life time. This construction also improves the control of pressure distribution over the sheet material.

In particular, the sealing roller may have a diameter less than that of the rotatable path-defining roller. For example, the sealing roller may have a diameter which is from one tenth to one third of the diameter of the rotatable path-defining roller, thereby enabling the torque which needs to be applied to be further reduced. The sealing roller preferably extends in a straight line parallel to the associated rotatable path-defining roller axis.

The sealing roller may be formed of a material having a coefficient of friction (as measured against stainless steel) of less than 0.3, preferably from 0.05 to 0.2, for example highly polished metals such as steel, especially Cr—Ni steel and Cr—Ni—Mo steel, a metal coated with Ni-PTFE (NIFLOR—Trade Mark), a polymer material such as PTFE (poly tetra fluoro ethylene), POM (polyoxymethylene), HDPE (high density polyethylene), UHMPE (ultra high molecular weight polyethylene), polyurethane, PA (polyamide), PBT (polybutyl terephthalate) and mixtures and composites thereof.

The buffer is preferably closed to the environment. The apparatus may further comprise means for returning liquid from the buffer to the treatment chamber. The buffer may consist only of the drip chambers. Alternatively, the drip chambers may be connected to a container into which treatment liquid may pass from the drip chambers, means being provided to return this treatment liquid to the treatment chamber. The container is advantageously a flexible container, which expands in volume as it is filled with liquid, thereby enabling the buffer to remain substantially closed to the environment. The means for returning treatment liquid from the buffer to the treatment chamber is preferably a pump positioned in a line from the container to the treatment chamber.

Means may be provided for moving the rotatable path-defining rollers away from each other to enable access to the photographic sheet material. This may be useful in the event of jams. Moving the path-defining rollers away from each other removes the necessity for the rollers to remain in contact with each other when the apparatus is idle. In one embodiment of the roller opening means, the rotatable path-defining rollers are rotatable on respective roller shafts, the rollers being biased together. At least one end of the first roller shaft is provided with a rotational drive means for transporting the sheet material in the processing direction. At each end of the second roller shaft displacement means are provided, for relative displacement of the second roller away from and to the first roller.

Preferably, at least one of the rotatable path-defining rollers constitutes a drive roller for driving the sheet material along the sheet material path. Constituting the roller as a drive roller enables the vessel to be constituted in a particularly simple manner. Alternatively, the rollers may be freely rotating, alternative drive means being provided to drive the photographic sheet material through the apparatus.

The housing of the apparatus is a static structure which serves to support the rotatable path-defining rollers. Preferably, the housing includes an upper portion closing the vessel from the outside. The dynamic liquid level may correspond to the location of the upper portion of the vessel, or there may be an air gap therebetween, for example where the liquid level control means comprises an overflow outlet. It is preferred that the overflow outlet does not drain into the buffer. Treatment liquid passing through the overflow may be recycled if desired. The overflow may be connected to an air trap to avoid any environmental air from entering the treatment chamber.

Alternatively or additionally, the apparatus may further comprise sensing means for sensing the level of treatment liquid in the vessel and control means, responsive to the output of the sensing means, to adjust the level of treatment liquid in the vessel to a predetermined level.

Even in the case of an air gap being present, any evaporation of the treatment liquid in the vessel is brought quickly to a stop. The housing may include a treatment liquid circulation passage located below the dynamic liquid level.

In an alternative embodiment, the dynamic liquid level is defined by an upper wall of the housing, thereby excluding the possibility of an air space above liquid in the treatment chamber. In this embodiment, the upper portion of the housing may include means to facilitate depressurising the vessel, such as a closeable valve.

An apparatus for the processing of photographic sheet material may comprise a plurality of vessels according to the invention mounted one beside another, to define a substantially straight material path through the apparatus. The vessels are preferably coupled together in a closed manner. The vessels may be separated from each other by one or more intermediate regions, especially between developer and fixer vessels. It may on the other hand be unnecessary to provide an intermediate region between the fixer and wash vessels. It is advantageous to connect each vessel to adjacent vessels in the apparatus in a closed manner. By the term "closed manner" in this specification is meant that each vessel is so connected to adjacent vessels that no vessel is open to the environment. By connecting vessels together in this manner, the evaporation, oxidation and carbonisation of treatment liquids can be significantly reduced. This may be achieved according to a preferred embodiment of the present invention, in that one of the vessels may be spaced from the next adjacent vessel by a closed intermediate region. It may also be advantageous to provide a closed entry region in advance of the first treatment vessel and/or a closed exit region following the final treatment vessel, thereby to protect the treatment vessels from the environment.

The present invention enables the sheet material path through the plurality of vessels to be substantially straight. A straight path is independent of the stiffness of the sheet material and reduces the risk of scratching compared with a circuitous path. However, it is also possible for some further vessels of the apparatus may be mounted in a stack one above the other, to form an apparatus with a horizontal/vertical hybrid configuration.

Preferably, a first drip tray is provided in the intermediate region below the nip of the sheet material outlet of the one vessel and a second drip tray is provided in the intermediate region below the nip of the sheet material inlet of the next adjacent vessel.

Each vessel may be of modular construction and provided with means to enable the vessel to be mounted directly beside an identical or similar other vessel. Alternatively, the apparatus may take an integral or semi-integral form in which the means for connecting each vessel to adjacent vessels in a closed manner is constituted by common housing walls of the apparatus. By the term "semi-integral form" we intend to include an apparatus which is divided by a substantially horizontal plane passing through all the vessels in the apparatus, particularly the plane of the sheet material path, enabling the apparatus to be opened up for servicing purposes, in particular to enable easy access to the rollers.

In use, the sheet material is fed into the apparatus at a level below the dynamic liquid level and therefore processing takes place below this level. It is preferable that, during operation of the apparatus, the dynamic liquid level is also above the nip plane. Uniform processing of the sheet material can thereby be assured.

The apparatus may be adapted in that means are provided to circulate the treatment liquids (including wash water) through the treatment vessels and means are provided to maintain the treatment liquids at a predetermined temperature. After passing through the treatment liquids, the sheet material is dried in a drying vessel.

DETAILED DESCRIPTION OF THE INVENTION

The invention will be described by the following illustrative embodiments with reference to the accompanying drawings without the intention to limit the invention thereto, and in which.

Figure 1:
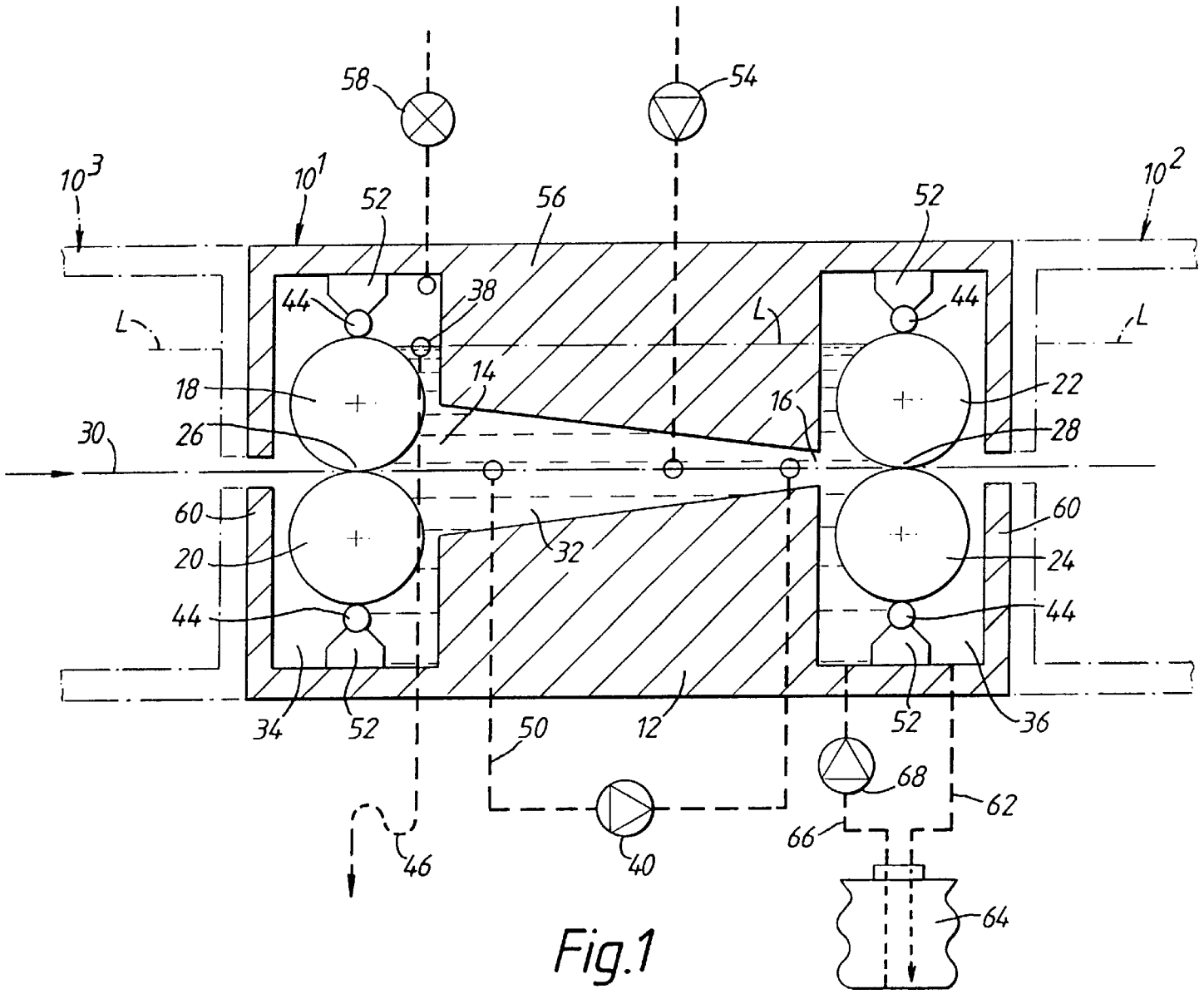
FIG. 1 shows a diagrammatical cross-section of a processing apparatus including a plurality of vessels according to the invention, with treatment liquid located in the treatment chamber.
Figure 2:
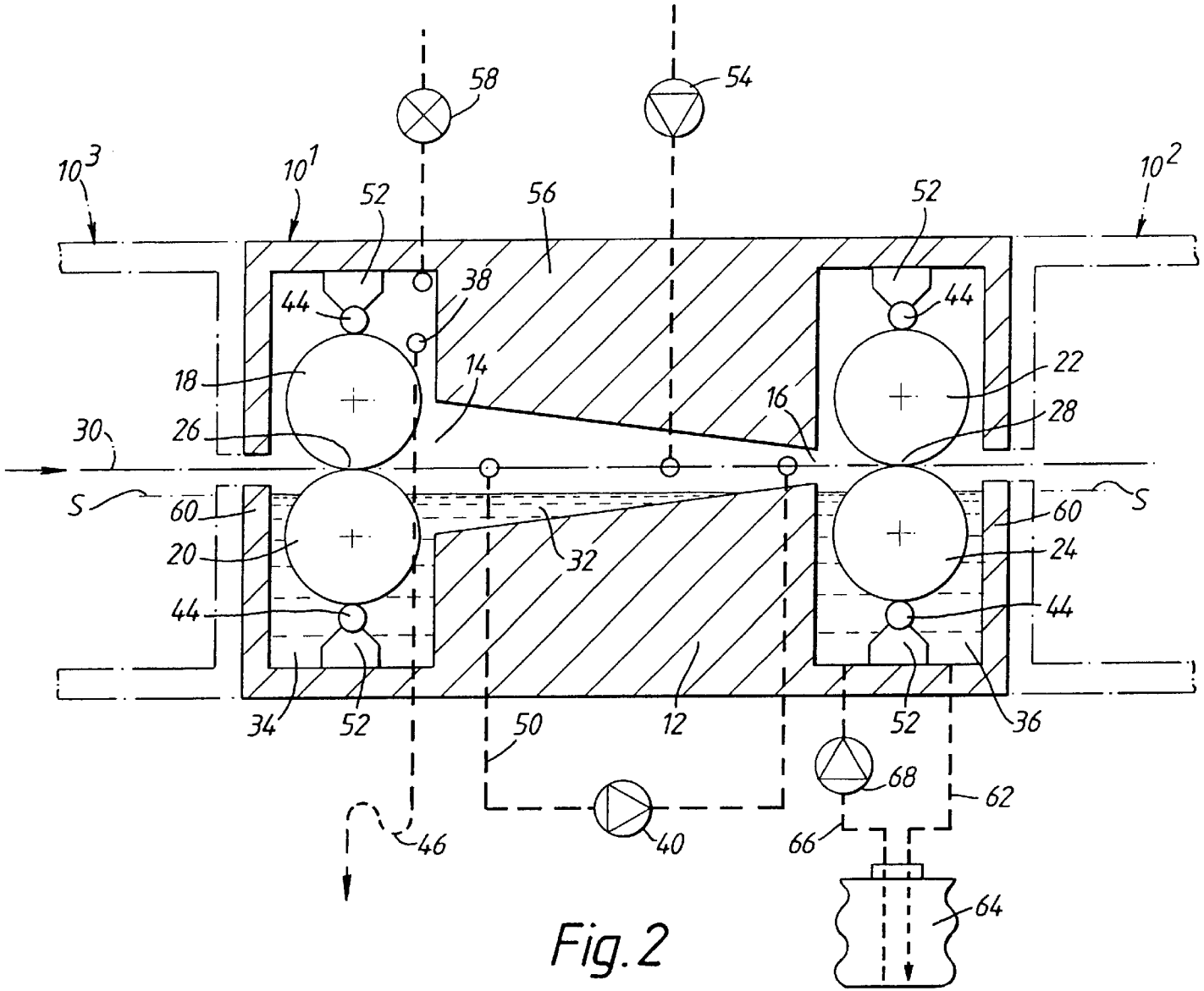
FIG. 2 is a view, similar to FIG. 1, where the treatment liquid has been drained into a buffer.

As shown in FIGS. 1 and 2, an apparatus for the processing of photographic sheet material comprises a plurality of treatment vessels $\mathbf{10}^1$, $\mathbf{10}^2$, $\mathbf{10}^3$ mounted one beside another to define a apparatus. In the Figures, vessels $\mathbf{10}^2$, and $\mathbf{10}^3$ are only partly shown. The sheet material path 30 through the vessels $\mathbf{10}^1$, $\mathbf{10}^2$, $\mathbf{10}^3$ is substantially straight. Referring in particular to vessel $\mathbf{10}^1$, it will be seen that each vessel comprises a housing 12 having a sheet material inlet opening 14 and a sheet material outlet opening 16. The entrance opening 14 is closed by a pair of rotatable path-defining rollers 18, 20 urged towards each other to form an entrance nip 26 therebetween.

The sheet material path 30 extends through the entrance and exit nips 26, 28. Similarly, the exit opening 16 is closed by a pair of rotatable path-defining rollers 22, 24 urged towards each other to form an exit nip 28 therebetween. The entrance and exit nips 26, 28 lie on a common plane, the nip plane, and define a generally horizontal sheet material path 30 through the vessel 10. One of the rotatable path-defining rollers of each pair constitutes a drive roller for driving the sheet material along the sheet material path The housing 12 includes an upper wall 56 closing the vessel from the outside. The path-defining rollers 18, 20, 22, 24 and the housing 12 define a closed treatment chamber 32 within the vessel 10.

Each path-defining roller is associated with a sealing roller 44 for sealing the associated path-defining roller to the housing 12. Each sealing roller 44 is carried by a longitudinal bearing 52 constituting a stationary sealing member which seals the sealing roller to the housing 12. It will be seen that the sealing rollers 44 contact the associated path-defining rollers at a position located 180° from the nip 26, 28.

A first drip chamber 34 is provided in the intermediate region below the nip 36 of the sheet material inlet 14 and a second drip chamber 36 is provided in the intermediate region below the nip 28 of the sheet material outlet 16. The two drip chambers 34, 36 are positioned to receive liquid escaping from the treatment chamber 32 through the nips 26, 28 and between the path-defining rollers 18, 20, 22, 24 and the sealing rollers 44. The drip chambers 34, 36 are closed to the environment.

Treatment liquid is fed to the vessel by a pump 54. The upper housing wall 56 includes a closeable valve 58, which can be opened to facilitate depressurising the vessel. So long as the path-defining rollers 18, 20, 22 and 24 continue to rotate, an overflow outlet 38 defines a dynamic liquid level L in the treatment chamber 32 above the sheet material path 30, as shown in FIG. 1. A liquid trap 46 is provided in the line from the overflow outlet 38 to act as a valve restricting any flow of environmental air into the treatemnt chamber 32 when the apparatus is in use. To restrict the effective air space above the treatment liquid in the treatemnt chamber, it would be preferred to site the liquid trap 46 closer to the overflow outlet 38 than is shown in the Figures. Liquid exiting through the overflow outlet 38 is recycled or discarded. The housing 12 includes a treatment liquid circulation passage 50 located below the dynamic liquid level L, liquid flow through the circulation passage being controlled by a circulation pump 40. The circulation passage withdraws treatment liquid from the vessel and returns it again to the vessel approximately at the level of the nip plane.

As shown in FIG. 2, when the path-defining rollers cease to rotate, treatment liquid escapes through the inlet and exit nips 26, 28 and between the path-defining rollers and their associated sealing rollers 44, to enter the drip chambers 34, 36. The total volume of the drip chambers 34, 36 is such that a static liquid level S is established, which level lies below the sheet material path 30, without the drip chambers overflowing. To help achieve this, each drip chamber has a delimiting wall 60 the upper edge of which lies close to the sheet material path 30. Treatment liquid recovered from the drip chambers 34, 36 may be recirculated. In particular, as shown in FIG. 2, part of the treatment liquid in the drip chamber 36 may be allowed to pass via line 62 into a closed flexible container 64, forming part of the buffer, from which it may be returned to the treatment chamber 32 via line 66 by operation of a pump 68. The drip chamber 34 may be similarly provided with a flexible container (not shown), or the two drip chambers 34, 36 may be connected to the same flexible container.

Treatment liquid returning to the treatment chamber 32 may optionally pass by way of a silver recovery (e.g. electrolysis) unit.

We claim:

1. A vessel for the wet processing of sheet material, comprising:

a housing (12) having entrance and exit openings (14, 16) defining a generally horizontal sheet material path (30) through the vessel (10), said entrance opening (14) being closed by a pair of rotatable path-defining rollers (18, 20) urged towards each other to form an entrance nip (26) therebetween, through which said sheet material path (30) extends, said exit opening (16) being closed by a pair of rotatable path-defining rollers (22, 24) urged towards each other to form an exit nip (28) therebetween, through which said sheet material path (30) extends, whereby said rotatable path-defining rollers (18, 20, 22, 24) and said housing (12) define a closed treatment chamber (32) within said vessel (10), liquid level control means (38) to define a dynamic liquid level (L) in said treatment chamber (32) above said sheet material path (30); and one or more drip chambers (34, 36) positioned to receive liquid escaping from said treatment chamber (32) through said nips (26, 28) and between said rotatable path-defining rollers (18, 20, 22, 24) and said housing (12), characterised by a buffer which comprises said drip chambers (34, 36)) and has a maximum total volume such that a static liquid level (S) is established below said sheet material path (30), without said buffer overflowing.

2. A vessel according to claim 1, wherein said buffer includes a flexible container (64) into which treatment liquid is able to pass from said drip chambers (34, 36).

3. A vessel according to claim 1, further comprising means (40, 42) for returning liquid from said buffer (34, 36, 64) to said treatment chamber (32).

4. A vessel according to claim 1, wherein said buffer (34, 36, 64) is closed to the environment.

5. A vessel according to claim 1, wherein said liquid level control means comprises an overflow outlet (38) which does not drain into said buffer (34, 36, 64).

6. A vessel according to claim 5, wherein said overflow outlet (38) is connected to a valve restricting any flow of environmental air into said treatment chamber (32).

7. A vessel according to claim 1, wherein each rotatable path-defining roller (18, 20, 22, 24) is associated with sealing means (44) for sealing the associated rotatable path-defining roller to said housing (12).

8. A vessel according to claim 1, wherein said dynamic liquid level (L) is defined by an upper wall (56) of said housing (12).

9. An apparatus for the processing of photographic sheet material, comprising a plurality of vessels according to claim 1 mounted one beside another, to define a substantially straight material path (30) through the apparatus.

10. A method for the wet processing of sheet material, comprising:

feeding sheet material through a vessel (10) along a generally horizontal sheet material path (30) defined by a housing (12) having entrance and exit openings (14, 16), said entrance opening (14) being closed by a pair of rotatable path-defining rollers (18, 20) urged towards each other to form an entrance nip (26) therebetween, through which said sheet material path (30) extends, said exit opening (16) being closed by a pair of rotatable path-defining rollers (22, 24) urged towards each other to form an exit nip (28) therebetween, through which said sheet material path (30) extends, whereby said rotatable path-defining rollers (18, 20, 22, 24) and said housing (12) define a closed treatment chamber (32) within said vessel (10), and establishing an operative condition in which a dynamic liquid level (L) in said treatment chamber (32) lies above said sheet material path (30), characterised by establishing a non-operative condition in which a static liquid level S lies below said sheet material path (30) by receiving liquid escaping from said treatment chamber (32) through said nips (26, 28) and between said rotatable path-defining rollers (18, 20, 22, 24) and said housing (12) in a buffer comprising one or more drip chambers (34, 36), said buffer having such a maximum total volume such that said non-operative condition is established without said buffer overflowing.

* * * * *

UNITED STATES PATENT AND TRADEMARK OFFICE

CERTIFICATE OF CORRECTION

PATENT NO. : 5,984,542
APPLICATION NO. : 09/096671
DATED : November 16, 1999
INVENTOR(S) : Verlinden et al.

It is certified that error appears in the above-identified patent and that said Letters Patent is hereby corrected as shown below:

Title Page, Insert: -- [30] Foreign Application Priority Data ¶Jul. 28, 1997 [EP] Europe...97202323 --;

Column 1, line 17: "but:" should read -- but --;

Column 5, line 55: "path" should read -- path 30. --.

Signed and Sealed this

Thirty-first Day of July, 2007

JON W. DUDAS
*Director of the United States Patent and Trademark Office*